United States Patent [19]

Verble

[11] Patent Number: 4,825,613

[45] Date of Patent: May 2, 1989

[54] NON ROTATABLE APPARATUS FOR SECURING ROOFING INSULATION BLOCKS AND AN OUTER MEMBRANE

[75] Inventor: Patrick R. Verble, Fortville, Ind.

[73] Assignee: North American Roofing Company, Inc., Carmel, Ind.

[21] Appl. No.: 80,862

[22] Filed: Aug. 3, 1987

[51] Int. Cl.[4] ..... E04B 5/57; E04B 7/00

[52] U.S. Cl. ..... 52/408; 52/410; 52/509

[58] Field of Search ..... 52/408, 410, 509, 512, 52/515, 222

[56] References Cited

U.S. PATENT DOCUMENTS

| | | | |
|---|---|---|---|
| 2,201,129 | 5/1940 | Weiland | 52/509 |
| 4,162,597 | 7/1979 | Kelly | 52/410 |
| 4,282,050 | 8/1981 | Thiis-Evensen | 52/410 |
| 4,361,997 | 12/1982 | DeCaro | 52/512 |
| 4,380,413 | 4/1983 | Dewey | 52/410 |
| 4,658,558 | 4/1987 | Verble | 52/410 |
| 4,686,808 | 8/1987 | Triplett | 52/512 |
| 4,688,361 | 8/1987 | Kelly | 52/410 |

FOREIGN PATENT DOCUMENTS

| | | | |
|---|---|---|---|
| 2300798 | 7/1974 | Fed. Rep. of Germany | 52/410 |
| 294990 | 4/1932 | Italy | 52/604 |

*Primary Examiner*—James L. Ridgill, Jr.
*Attorney, Agent, or Firm*—Woodard, Emhardt, Naughton, Moriarty & McNett

[57] ABSTRACT

A roofing system including insulation blocks and a flexible membrane. A plurality of insulation blocks are positioned atop a roof frame with the longitudinal edges of the blocks being spaced apart. A plurality of plates are mounted atop the insulation blocks with the plate being positioned adjacent the four corners of adjacent but spaced apart insulation blocks. Downwardly depending ribs from the plate space the insulation blocks apart while preventing rotation of the plate. Additional ribs extend form the plates against and into the insulation blocks further limiting movement of the plates. A fastener secures each plate to the roof frame. A membrane extends over the entire roof and is attached thereto by adhesive means located atop the plates.

22 Claims, 3 Drawing Sheets

NON ROTATABLE APPARATUS FOR SECURING ROOFING INSULATION BLOCKS AND AN OUTER MEMBRANE

BACKGROUND OF THE INVENTION

This invention relates to an apparatus for attaching a roofing membrane and insulating blocks to a roof.

In my U.S. Pat. No. 4,658,558, I have discussed various devices for attaching flexible sheet material, for example, E.P.D.M. rubber membrane, to a roof. Disclosed therein are plates which are fixedly mounted to the roof with the membrane then extending over the plates and secured thereto by locks forcing the membrane downwardly into the plates without the membrane being pierced. In such a manner, the structural integrity of the membrane is maintained and a moisture barrier is provided over the roof.

In U.S. Pat. No. 4,162,597 there is disclosed a plurality of interlocking insulation blocks mounted atop a roof and secured thereto by fasteners. A plurality of plates are secured to the insulation blocks by the fasteners with a rubber membrane then being adhesively secured to the plates.

When affixing plates to a roof by fasteners such as shown by either of the two aforementioned patents, it is possible for the plate to rotate thereby backing out the fastener from the roof and allowing the attached membrane to become loose and eventually tear. I have therefore designed a plate having a plurality of downwardly extending ribs positioned between adjacent insulation blocks thereby spacing the insulation blocks apart while preventing the plate from rotating. The plate and attached membrane is thereby permanently secured to the roof without the possibility of the plate becoming dislodged from the roof. In an alternate embodiment, I have provided a plurality of radially extending ribs which interferingly contact the insulation blocks providing an additional means for preventing rotation of the plate.

SUMMARY OF THE INVENTION

One embodiment of the present invention is a roof cover comprising, at least two insulation sheets positioned atop a roof, a plate with an aperture extending therethrough, fastening means extending through the aperture and operable to secure the plate atop the two insulation sheets to the roof, and, separating means depending from the plate and extending between the two insulation sheets separating the two insulation sheets apart and limiting movement of the plate.

Another embodiment of the present invention is a device for attaching insulation sheets to a roof comprising, a plate main body with an aperture extending therethrough, fastening means extending through the aperture and operable to secure the plate main body atop insulation sheets to the roof, and, separating means depending from the plate main body and extending between the insulation sheets separating the insulation sheets and limiting movement of the plate main body.

A further embodiment of the present invention is a device for securing insulation sheets to a roof comprising, a member having a fastener hole extending therethrough and a rib depending therefrom extendable between the sheets to limit movement of the member.

It is an object of the present invention to provide a new and improved means for attaching a roofing membrane to a roof.

A further object of the present invention is to provide a plate for attaching a roofing membrane to a roof with means provided on the plate preventing rotation of the plate and disengagement of the plate from the roof.

Related objects and advantages of the present invention will be apparent from the following description.

DESCRIPTION OF THE PREFERRED EMBODIMENT

Figure 2:
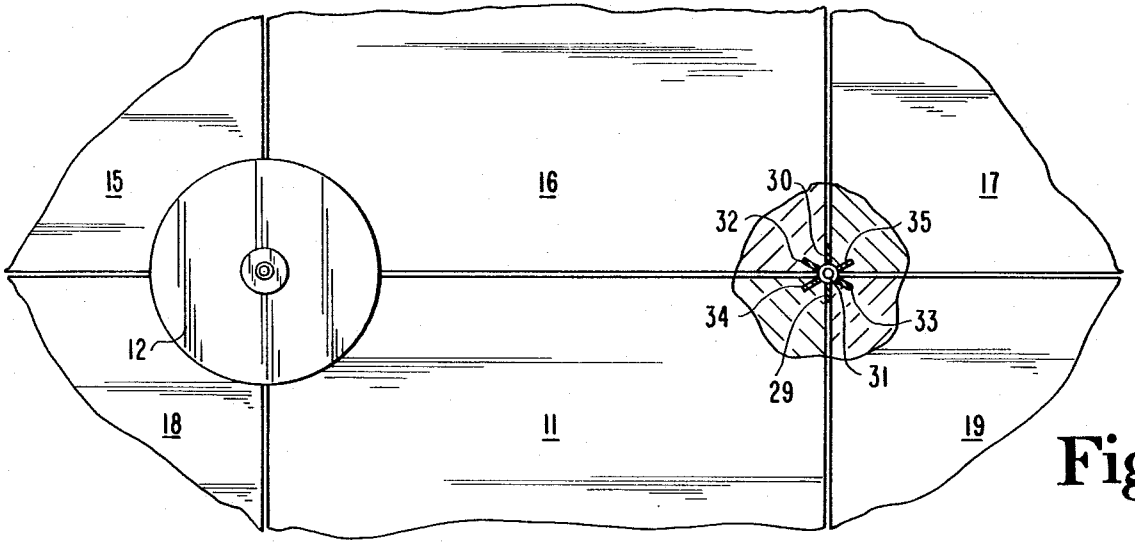
FIG. 2 is a fragmentary top view of the roof of FIG. 1.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1:
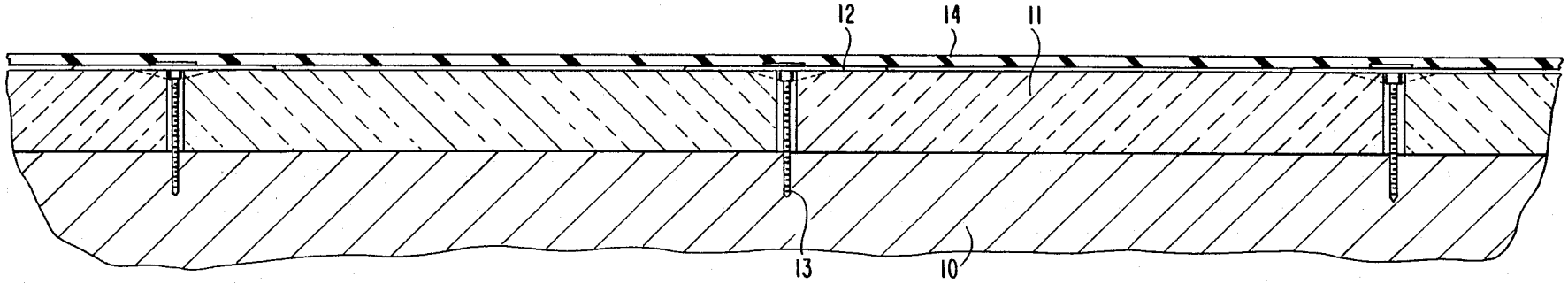
FIG. 1 is a fragmentary cross-sectional view of a roof incorporating my new invention.

Referring now more particularly to FIG. 1, there is shown a conventional roof frame 10 having positioned there atop a plurality of insulation blocks 11 with plates 12 incorporating my new invention being mounted atop blocks 11 by conventional fastening devices 13. A flexible membrane 14 in turn is mounted atop plates 12. The insulation blocks are arranged in rows and are spaced apart to allow downwardly extending ribs of the plate to extend therebetween as will be detailed later in this specification. Thus, insulation block 11 is positioned between insulation blocks 18 and 19 (FIG. 2) and adjacent but spaced from insulation block 16 which in turn is spaced between insulation blocks 15 and 17. The flexible membrane 14 is removed from FIG. 2 along with the top portion of the plate positioned at the intersection of insulation blocks 16,17,11 and 19 to more fully illustrate the interaction of the plate relative to the insulation blocks.

Figure 3:
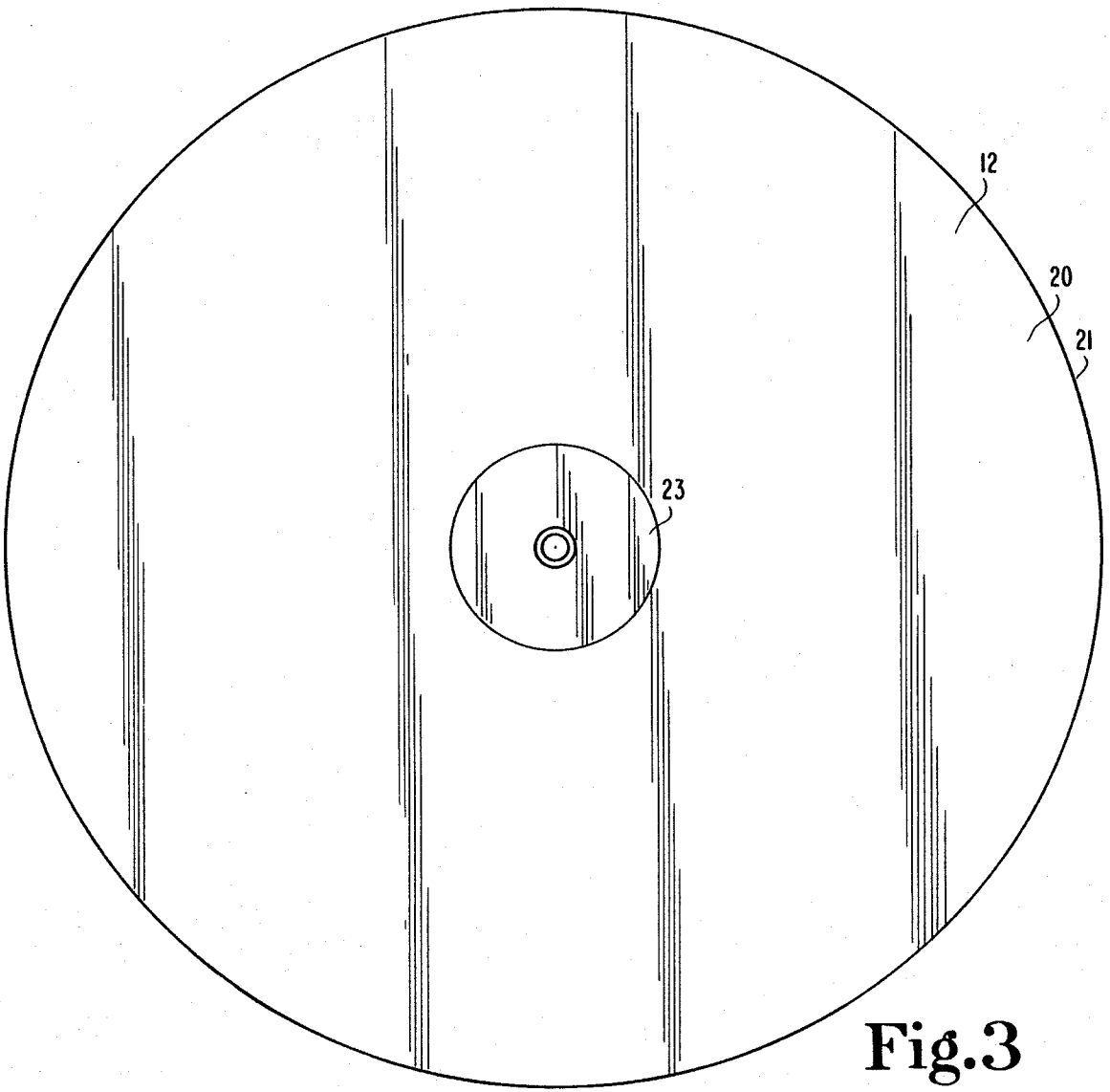
FIG. 3 is an enlarged top view of the roofing plate.
Figure 5:
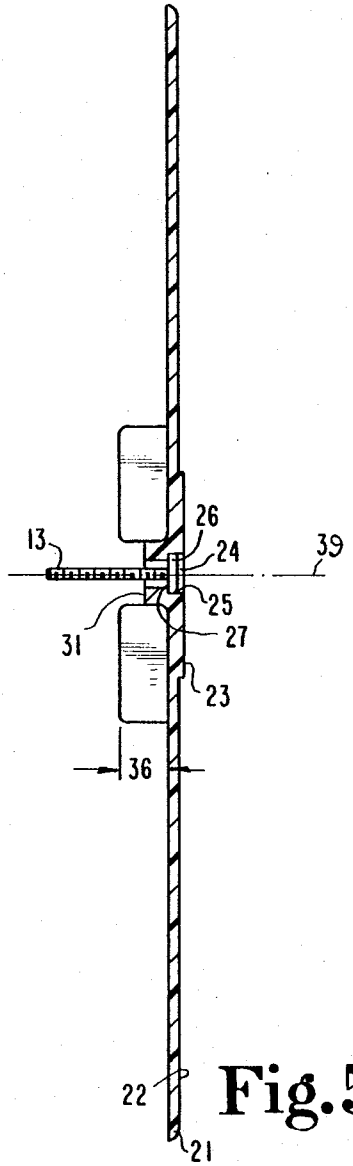
FIG. 5 is a cross-sectional view taken along the line 5—5 of FIG. 4 and viewed in the direction of the arrows.

The plates mounted atop the insulation blocks are identical and have a circular main body 20 (FIG. 3) although additional configurations of the main body are possible. That is, the plate main body may take any polygonal configuration in lieu of a circular configuration. The circumferentially extending edge 21 (FIG. 5) is radiused or rounded allowing membrane 14 to extend from atop the upper surface 22 (FIG. 5) of the plate to a position immediately atop the insulation blocks without incurring a sharp edge. The center portion 23 of the plate main body is slightly raised and has a hole 24 extending centrally therethrough. In one embodiment, center portion 23 extends above upper surface 22 by approximately 0.025 inches. A counterbore 25 extends around hole 24 allowing fastener 13 to extend therethrough with the head 26 of the fastener abutting the horizontal ledge formed by counterbore 25. Fasteners 13 extend between the insulation blocks and into the roof frame 10 securely anchoring the plates thereto. Surface 25 is convex in that the surface has a reduced diameter midway between plate surface 22 and the counterbore ledge 27 thereby providing a restriction limiting outward movement of head 26 of fastener 13.

A plurality of ribs extend radially outward from hole 24 and downwardly from the bottom surface 28 of the plate main body. Two of the ribs form separator 29 and 30 (FIG. 4) which extend between and position apart insulation blocks 11 preventing the plate from rotating. Ribs 29 and 30 are integrally joined to bottom surface 28 and to a downwardly extending boss 31 (FIG. 5) surrounding hole 24. Ribs 29 and 30 are parallel and are positioned to intersect the longitudinal axis 39 extending through hole 24. Interference means are provided by two pairs of ribs 32–33 and 34–35 which extend radially outward from hole 24 and downwardly from bottom surface 28 to interferringly press against insulation blocks 11 thereby gripping the insulation blocks and providing additional means to prevent rotation of the plate. Ribs 32 and 33 are parallel and are positioned to intersect axis 39. Likewise, ribs 34 and 35 are parallel and are positioned to intersect the longitudinal axis. Ribs 35 and 33 are positioned respectively 60 degrees and 120 degrees in a counterclockwise direction from rib 30 as viewed in FIG. 4. Ribs 34 and 32 are positioned 240 degrees and 300 degrees in a counterclockwise direction from rib 30 as viewed in FIG. 4. Alternative embodiments include a plate main body having the pair of separator ribs 29 and 30 but without the gripping ribs 32–33 and 34–35. A further embodiment includes the gripper ribs 32–33 and 34–35 but at angles relative to the separator ribs 29 and 30 different from the angles shown in FIG. 4.

Figure 4:
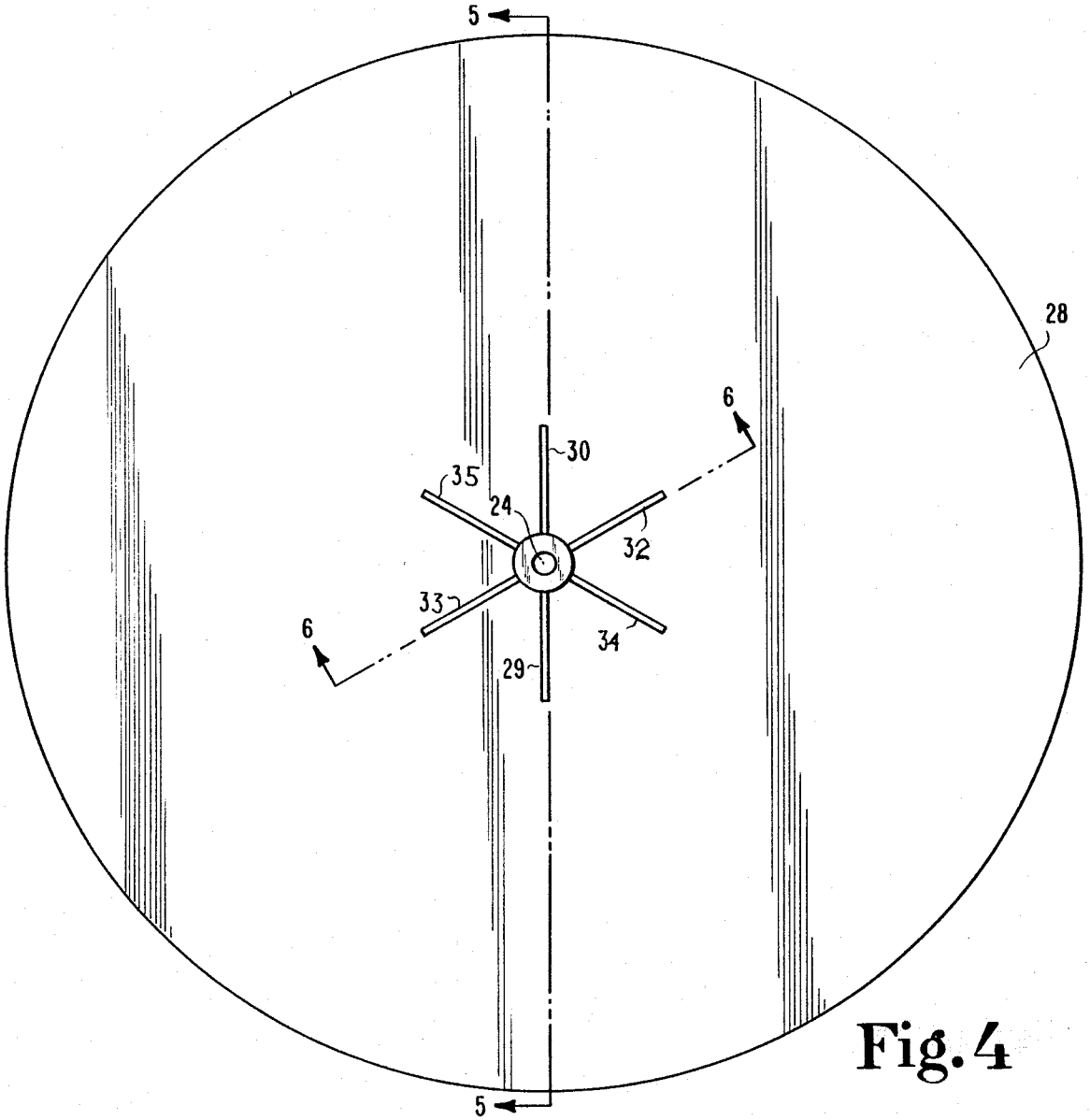
FIG. 4 is a bottom view of the plate of FIG. 3.

The six ribs depicted in FIG. 4 are integrally joined to boss 31 with the separator ribs having a different configuration than the gripper ribs. Separator ribs 29 and 30 extend downwardly beneath boss 31 and have a constant height 36 as the ribs extend radially outward. In one embodiment, the height 36 of ribs 29 and 30 was approximately ⅓ of an inch. In the same embodiment, the separator ribs 29 and 30 extended in a radial direction approximately 1.5 inches from axis 39. The gripper ribs 32–33 and 34–35 do not extend downwardly beneath boss 31 and have a linearly decreasing height from the bottom surface of boss 31 to the bottom surface 28 of the plate main body. The gripper ribs extend radially outward a distance equal to the length of the separator ribs.

In order to install the roof cover incorporating the present invention, a plurality of insulation blocks are positioned atop the roof frame so that the blocks are aligned. For example, blocks 15,16,17,18,11 and 19 are aligned but have their edges spaced apart. Plates 12 are then positioned atop the four adjacent corners of four insulation blocks. One such plate is shown atop the adjacent four corners of insulation blocks 15,16,18 and 11 in FIG. 2 with a second plate atop the four corners of insulation blocks 16,17,11 and 19. The second plate is shown in fragment to illustrate the positioning of the boss 31 which extends downwardly and between the four insulation corners. Separator ribs 29 and 30 are positioned respectively between insulation blocks 11 and 19 and between insulation blocks 16 and 17 thereby separating the insulation blocks apart while preventing the plate from rotating and thereby backing out fastener 13. The four gripper ribs extend interferringly into the insulation blocks. For example, ribs 32 and 33 extend respectively atop and into insulation blocks 16 and 19 whereas ribs 34 and 35 extend interferingly against insulation blocks 16 and 17. In one embodiment, plates 12 are produced from plastic whereas the insulation blocks are produced from conventional insulation materials, such as wood fibre.

The top surface 22 of the plate main body is provided with adhesive means for securing the rubber membrane 14 (FIG. 1) thereto. Membrane 14 is secured to the roof only by being secured to plates 12 and is not secured to the insulation blocks at locations between plate 12. Adhesive means may take many forms. For example, the entire upper surface 22 or only a portion thereof may be provided with an adhesive means which is self-securing to the lower surface of membrane 14. The adhesive means may be provided atop the plate during the manufacture of the plate or may be subsequently added by the installer. The adhesive may take the form of a liquid painted on to the top surface of the plate. Alternatively, a double-backed adhesive strip may be secured to the upper surface of the plate and then subsequently adhered to the lower surface of the rubber membrane.

Figure 6:
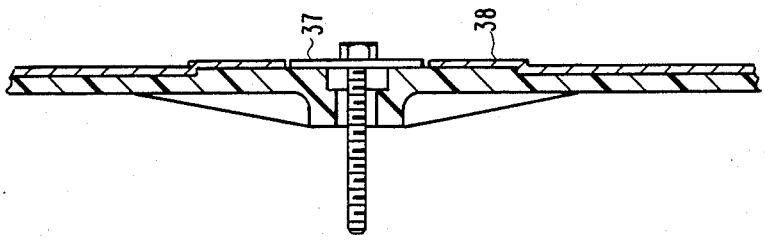
FIG. 6 is a fragmentary enlarged cross-sectional view taken along line 6—6 of FIG. 4 and viewed in the direction of the arrows.

A fragmentary cross-sectional view of the plate is depicted in FIG. 6 with an alternate embodiment of the fastener used to secure the plate to the roof frame. In the embodiment depicted in FIG. 6, extension means are provided by a washer 37 which is positioned beneath the head of the fastener with the washer resting atop the plate thereby distributing the fastening load from the fastener head through the washer to the top surface of the plate. The adhesive means 38 is shown as being provided on the top surface of the plate and surrounding the washer. In lieu of utilizing an adhesive strip, the plate may be welded to the rubber membrane by the use of direct heat or by chemicals. In such a case, the plate is integrally joined to the membrane.

Many variations are contemplated and included in this invention. For example, the plates are shown as being positioned immediately atop the four adjacent corners of four insulation blocks. Alternatively, the plate may be positioned atop the longitudinally extending adjacent edges of two insulation blocks with the separator ribs spacing the two blocks apart and the gripper ribs extending grippingly into the two insulation blocks.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A roof cover comprising:

at least two insulation sheets positioned atop a roof;

a plate with an aperture extending therethrough;

fastening means extending through said aperture and operable to secure said plate atop and said two insulation sheets to a roof; and, separating means depending downwardly from said plane and extending between said two insulation sheets horizontally separating said two insulation sheets apart and limiting movement of said plate.

2. The roof cover of claim 1 further comprising adhesive means atop said plate.

3. The roof cover of claim 1 and further comprising:

extension means removably positioned between said fastening means and said plate to distribute force from said fastening means over said plate.

4. The roof cover of claim 1 and further comprising:

interference means depending from said plate and extending against said two insulation sheets limiting movement of said plate relative thereto.

5. The roof cover of claim 4 wherein:

said interference means includes a plurality of gripping ribs extending downwardly from said plate and having a decreasing size as said ribs extend radially outward from said aperture.

6. The roof cover of claim 1 wherein:

said separating means includes a separator rib which extends radially outward from said aperture and is operable to limit rotation of said plate.

7. The roof cover of claim 6 wherein:

said plate includes a downwardly extending boss integrally attached thereto with said aperture extending through said boss and said rib extending outwardly from said boss, said plate further includes a counterbore recess opening upwardly forming a continuous ledge surrounding said aperture and upon which said fastening means abuts securing said plate to said roof, said plate further includes an upraised portion surrounding said counterbore; and further comprising:

interference means including a plurality of gripping ribs extending downwardly from said plate against said two insulation sheets and having decreasing size as said gripping ribs extend radially outward from said boss.

8. The roof cover of claim 7 wherein:

said separating means includes a pair of aligned separator ribs with said boss positioned therebetween.

9. The roof cover of claim 8 and further comprising:

a plurality of more than two insulation sheets positioned atop a roof;

a plurality of plates with apertures extending therethrough;

a plurality of fastening means extending through said apertures and operable to secure said plurality of plates atop said plurality of insulation sheets to a roof; and, a plurality of separating means depending from said plurality of plates and extending between said plurality of insulation sheets separating said plurality of insulation sheets and limiting movement of said plurality of plates.

10. A roof cover, comprising:

at least two insulation sheets positioned atop a roof;

a member having a fastener hole extending therethrough and a separator rib depending downwardly therefrom, said separator rib extending between said sheets and horizontally separating said sheets thereat to limit movement of said member; and a fastener extending through said fastener hole and operable to secure said plate atop said sheets and to a roof.

11. The roof cover of claim 10 wherein there are two separator ribs.

12. The roof cover of claim 10 and further comprising:

adhesive means atop said member; and, interference means depending from said member and extendable against said insulation sheets limiting movement of said member relative thereto.

13. The roof cover of claim 12 wherein:

said adhesive means includes at least one strip with opposite adhesive sides one of which is in contact with said member and the other of which faces upwardly;

said member is a plate and said interference means includes a plurality of gripping ribs extending downwardly from said plate and having a decreasing size as said gripping ribs extend radially outward from said hole which is centrally located on said plate.

14. The roof cover of claim 10 wherein:

said separator rib extends radially outward from said hole and is operable to limit rotation of said member which is a plate.

15. The roof cover of claim 14 wherein:

said plate includes a downwardly extending boss integrally attached thereto with said hole extending through said boss and said separator rib extending outwardly from said boss, said plate further includes a counterbore recess opening upwardly forming a continuous ledge surrounding said hole, said plate further includes an upraised portion surrounding said counterbore.

16. A device for securing at least two insulation sheets to a roof, comprising:

a plate having an aperture extending therethrough, the aperture having a greatest width;

fastening means extendable through said aperture and horizontally between the insulation sheets to secure said plate atop the insulation sheets and to a roof;

at least one planar separator rib extending downwardly from said plate and radially from said aperture, said at least one rib having a substantially constant height and having a radial length substantially greater than the greatest width of the aperture, said at least one rib extendable between adjacent sheets and horizontally separating adjacent sheets thereat;

at least one gripping rib extending downwardly from said plate and pressing downwardly into one of the two insulation sheets, said at least one gripping rib having a maximum height equal to approximately one half of the height of said at least one separator rib.

17. The device for securing at least two insulation sheets to a roof of claim 16 wherein said at least one gripping rib extends radially from said aperture and decreases in size outwardly.

18. The device for securing at least two insulation sheets to a roof of claim 16 wherein there are at least two separator ribs located 180° apart.

19. A roof cover, comprising:

at least two insulation sheets positioned atop a roof;

a plate having an aperture extending therethrough;

fastening means extending through said aperture and horizontally between the insulation sheets to secure said plate atop said two insulation sheets and to a roof;

a separator rib extending radially and downwardly from said plate and extending vertically between said sheets so as to horizontally separate said two insulation sheets thereat; and at least one gripping rib extending downwardly from said plate and pressing downwardly against at least one of said sheets so as to partially deform said at least one of said sheets.

20. The roof cover of claim 19 wherein there are at least two separator ribs.

21. The roof cover of claim 19 wherein said separator rib extends downwardly farther than said gripping rib.

22. The roof cover of claim 21 wherein said gripping rib extends radially from said aperture and decreases in size outwardly.

* * * * *

UNITED STATES PATENT AND TRADEMARK OFFICE

CERTIFICATE OF CORRECTION

PATENT NO. : 4,825,613

DATED : May 2, 1989

INVENTOR(S) : Patrick R. Verble

It is certified that error appears in the above-identified patent and that said Letters Patent is hereby corrected as shown below:

On the cover page, line 10 of the Abstract, please change "form" to --from--.

In column 1, line 9, please change "insulating" to --insulation--.

In column 1, line 10, please change "discussed" to --disclosed--.

In column 2, line 45, please change "plate" to --plates--.

In column 3, line 21, after "two", please insert --additional--.

In column 3, line 21, after "of", please insert --gripper--.

In column 4, line 16, please change "plate" to --plates--.

In column 4, line 47, please change "plate" to --plates--.

In column 4, line 68, please change "plane" to --plate--.

Signed and Sealed this

Thirtieth Day of January, 1990

*Attest:*

JEFFREY M. SAMUELS

*Attesting Officer* *Acting Commissioner of Patents and Trademarks*